United States Patent [19]

Seavey

[11] Patent Number: 4,504,836

[45] Date of Patent: Mar. 12, 1985

[54] ANTENNA FEEDING WITH SELECTIVELY CONTROLLED POLARIZATION

[75] Inventor: John M. Seavey, Cohasset, Mass.

[73] Assignee: Seavey Engineering Associates, Inc., Cohasset, Mass.

[21] Appl. No.: 383,822

[22] Filed: Jun. 1, 1982

[51] Int. Cl.[3] ..... H01Q 13/02

[52] U.S. Cl. ..... 343/761; 343/786; 343/797

[58] Field of Search ..... 343/786, 772, 756, 727, 343/730, 790, 793

[56] References Cited

U.S. PATENT DOCUMENTS

| | | | |
|---|---|---|---|
| 2,483,217 | 9/1949 | Martin | 343/790 |
| 2,522,562 | 9/1950 | Blitz | 343/756 |
| 2,533,529 | 12/1950 | Spindler | 343/793 |
| 2,570,197 | 10/1951 | Bohnert et al. | 343/756 |
| 2,642,528 | 6/1953 | Albright | 343/795 |
| 2,680,810 | 6/1954 | Korman | 343/756 |
| 2,820,965 | 1/1958 | Sichak | 343/756 |
| 2,878,471 | 3/1959 | Butler | 343/756 |
| 3,215,957 | 11/1965 | Dantzig et al. | 343/756 |
| 3,707,721 | 12/1972 | McCartney | 343/766 |
| 4,021,814 | 5/1977 | Kerr et al. | 343/786 |
| 4,168,504 | 9/1979 | Davis | 343/786 |
| 4,375,052 | 2/1983 | Anderson | 333/21 A |
| 4,414,516 | 11/1983 | Howard | 333/21 |

*Primary Examiner*—Eli Lieberman
*Assistant Examiner*—Karl Ohralik
*Attorney, Agent, or Firm*—Charles Hieken

[57] ABSTRACT

A flat face annular grooved metal surface surrounds a circular waveguide opening coupled to a small dipole radiator which excites the circular waveguide in its fundamental propagating mode ($TE_{11}$). The dipole is arranged to rotate about its axis by means of an extension of its inner conductor, which forms a simple probe in a section of rectangular waveguide situated behind the circular waveguide. A dielectric shaft is fastened to the inner conductor and is brought to the outside of the rectangular waveguide where it is connected to a small motor. The motor is arranged so that it may be actuated remotely by any of several circuits. The dipole may be before the corrugated plate with bent arms. A pair of dipoles may be arranged perpendicular to each other with two separate coaxial connector antenna feed outputs for direct attachment to coaxial-type low-noise amplifiers.

12 Claims, 11 Drawing Figures

ANTENNA FEEDING WITH SELECTIVELY CONTROLLED POLARIZATION

The present invention relates in general to antenna feeding with selective polarization and more particularly concerns novel apparatus and techniques for illuminating a deep paraboloid reflector with a corrugated face antenna feed with selectively controlled polarization using mechanical elements of relatively low inertia easily driven by a small motor of such low power that it may be energized from the D.C. power supply of an associated receiver.

Earth stations for reception of satellite signals presently use the 3.7–4.2 GHz frequency band and require reflector antennas having diameters of 8 to 20 feet. To achieve high gain and low noise qualities from these antennas, prior techniques have used (among others), simple corrugated face feeds excited by the fundamental mode of a circular waveguide. These types of feeds are well-known for producing good performance in these installations because they efficiently illuminate reflectors having focal length-to-diameter (F/D) ratios of about 0.4 and larger, while reducing electrical noise pickup from the earth or from nearby interfering transmitters. Many present antenna reflectors use F/D ratios as small as 0.25, thus creating problems in attaining efficient illumination and high gain.

However, these feeds must be rotated in their entirety together with any connected auxiliary equipment, such as the low noise amplifier (LNA), to adjust the polarization angle. Present domestic satellites use transponders having orthogonal linear polarization. The apparent polarization (that is, the polarization angle as measured from the vertical at the earth Station) of the satellite as seen from the earth station varies considerably depending on the location of the earth station and the position of the satellite's stationary orbit. Rotating the entire feed and LNA causes severe practical problems with cable wrap-ups and alignment of the feed with respect to the focal point of the reflector. Both of these problems cause loss of signal and reliability degradation. Also, for those earth station installations which are configured to receive both simultaneous orthogonal polarizations a relatively expensive device known as an ortho-mode transducer is required to be connected to the feed to separate the two signals into two waveguide ports.

Accordingly, it is an important object of this invention to provide a device which permits remote rotation of the polarization angle of the antenna feed without the above disadvantages, and with only one moving part, while utilizing the proven qualities of the corrugated face.

A further object of this invention is to permit efficient illumination of deep reflectors (in the range of 0.25–0.35 F/D ratios) with the simultaneous ability to remotely adjust the polarization angle, if desired.

It is a still further object of this invention to provide means for achieving the dual polarization capability with coaxial-type LNA's while also achieving the advantages of efficient illumination for deep reflectors.

It is a further object of the invention to provide the above objects with a device which is compact, simple in construction, lightweight, low cost, weather resistant, and which fixes the feed body and the LNA, thus obviating cable wraps and alignment problems.

According to the invention, there is a corrugated face metal plate surrounded by a circular waveguide opening excited by rotatable polarized antenna means polarized in a predetermined direction, such as a dipole or dipole pair. In the case of the single dipole, remote means of polarization adjustment are afforded by extending the inner conductor of the dipole into a rectangular waveguide placed behind the circular waveguide so as to excite it in its fundamental $TE_{01}$ propagation mode. There is means, such as a dielectric shaft connected between the inner conductor and the shaft of a small motor or other actuator, for selectively rotating the polarized radiating means. The depth of the circular waveguide cavity and the consequent axial position of the dipole is preferably adjusted for optimum illumination of a given F/D-ratio reflector. According to another feature of the invention, a pair of crossed dipoles with coaxial LNA's provide dual polarized operation.

Numerous other features, objects and advantages of the invention will become apparent from the following specification when read in connection with the accompanying drawings in which.

Figure 1:
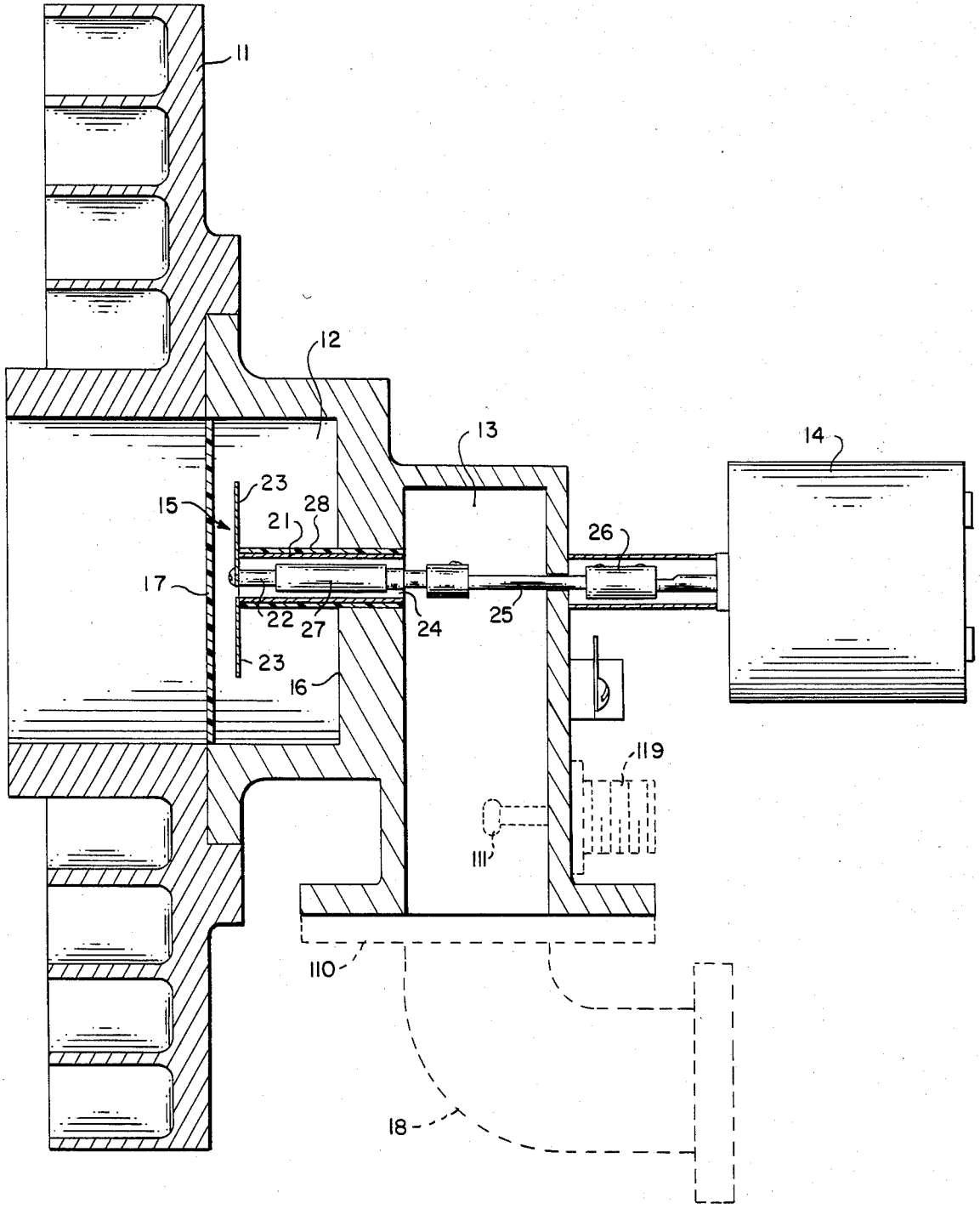
FIG. 1 is a diametrical sectional view of one embodiment of the invention.

With reference now to the drawing and more particularly FIG. 1 thereof, there is shown a diametrical sectional view illustrating one embodiment of the invention. A front corrugated metal face 11 is connected to a short length of circular waveguide 12 before a section of rectangular waveguide 13 aligned perpendicularly thereto. A small motor 14 is located concentrically to the circular waveguide 12 behind the assembly as shown. A dipole radiator 15 is one quarter waveguide wavelength before a metal wall 16 forming the end of the circular waveguide 12.

Figure 2:
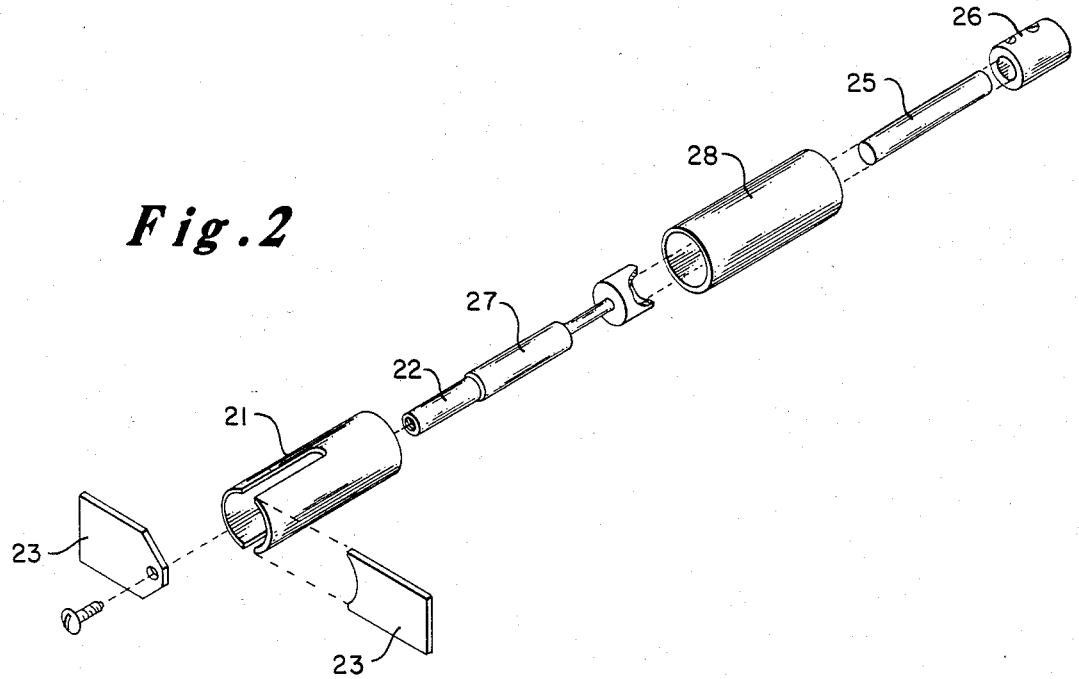
FIG. 2 is an exploded view of the dipole assembly.

Dipole 15 is of conventional construction, as shown in the exploded view of FIG. 2. Dipole 15 comprises a short cylinder 21 which is slotted at its outer end, an inner conductor 22 concentric to the short cylinder 21, and two flat metal arms 23 attached at right angles to cylinder 21. Inner conductor 22 extends through a short hole 24 in the metal wall connecting the circular 12 and rectangular 13 waveguides and then into rectangular waveguide 13 approximately one eighth wavelength. A dielectric shaft 25, (for example, of Teflon material), is fastened to the inner conductor 22 at this point and extends through the outer wall of the rectangular waveguide 13 and is connected to motor 14 through shaft coupling 26.

The position of the top wall of rectangular waveguide 13 is chosen in accordance with well-known engineering principles to be approximately one quarter waveguide length behind the axis of circular waveguide 12 for best impedance match. The dipole itself is tuned by adjusting its arm lengths to approximately 0.4 wavelength, and inner conductor 22 is fitted with a coaxial impedance transformer 27 so as to result in a good impedance match for the assembly.

In practice, a thin wall Teflon sleeve 28 is placed between dipole cylinder 21 and hole 24 through the common wall so as to act as a mechanical bearing. The hole length itself is chosen to be approximately one quarter wavelength for best operation. Environmental sealing of this assembly is accomplished by the use of a high-temperature dielectric window 17 in the form of a polyimide film with an adhesive backing (for example, Dupont "Kapton" material) which is placed between the corrugated face and the rear metal housing. Such material provides for environmental sealing while preventing performance deterioration during solar "outage" conditions in satellite service in which the sun focuses thermal energy at the antenna feed.

Motor 14 may be any one of a large number of types of standard motors, depending on the interconnection requirements to the attached equipment. A preferred motor is a small, 0.1 watt DC permanent magnet gearmotor capable of rotation speeds approximately 7 RPM at 12–15 volts DC and with a current drain of 2 milliamperes. Such a motor is easily capable of rotating dipole 15 because of the low inherent inertia and friction in the assembly. Actuation of motor 14 may be accomplished in a variety of ways, again depending on the interconnection requirements. Alternatively, dipole 15 may be rotated and positioned manually.

Figure 3:
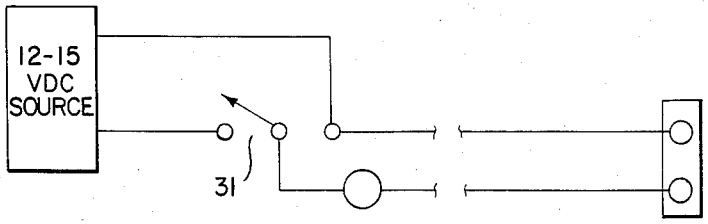
FIG. 3 is a schematic representation of circuitry for actuating the drive motor with a remotely located shorting-type switch.

FIG. 3 shows a circuit for causing motor 14 to rotate in one direction only through a remotely located shorting-type switch 31 which permits the earth station user to adjust the polarization for the best reception by starting and stopping motor 14, which may use the satellite receiver as a source of DC current. Shorting switch 31 short circuits the motor windings when the switch is "off", thus abruptly stopping the motor shaft and preventing "coasting".

Figure 4:
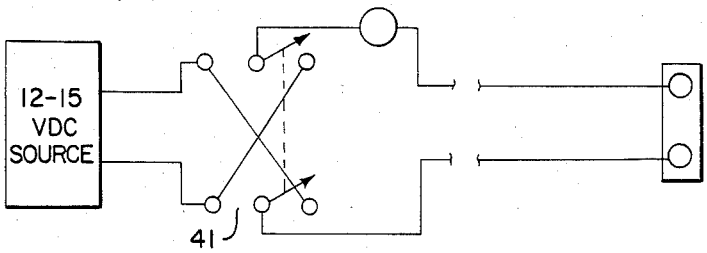
FIG. 4 shows circuitry for actuating the drive motor in either direction.

FIG. 4 shows a circuit allowing reversal of the rotation of the motor 14. A double-pole, three position shorting-type switch 41 is used with the same stopping advantages as described above and moves between a stable first disconnected position as shown to momentary contact with respective pairs of end terminals of switch 41.

Figure 5:
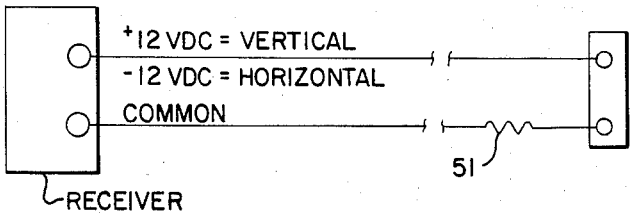
FIG. 5 shows circuitry for actuating the drive motor to move between only two orthogonal positions.

FIG. 5 shows a circuit limiting antenna feed motor 14 to exactly 90° of rotation. This feature may be useful where the feed is utilized with reflectors placed on polar or equatorial-type mountings. In this case, the motor is arranged to rotate its shaft into fixed mechanical stops where it continues to draw current until energized into the opposite direction as shown. A voltage dropping resistor 51 has been found useful to guard against excessive motor heating in this instance.

Figure 6:
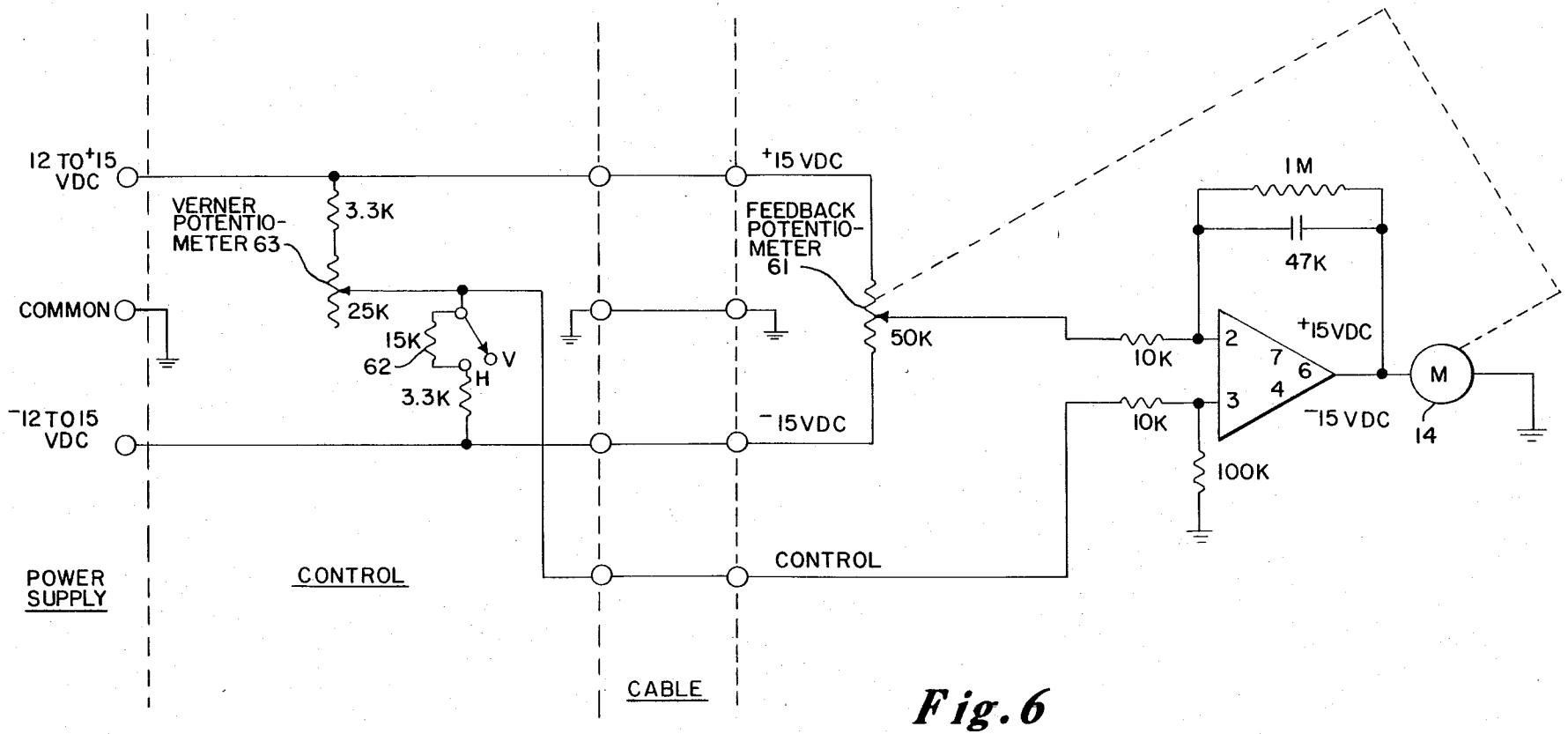
FIG. 6 shows feedback circuitry for selectively positioning the drive motor.

FIG. 6 shows a drive circuit with motor 14 coupled to potentiometer 61 which forms one part of a simple feedback loop. A fixed resistor 62 is switched in to command motor 14 to rotate exactly 90°, Vernier potentiometer 63 is used for fine adjustments of the polarization angle. The latter is useful when changing the earth station antenna's position from one satellite to another, or for making vernier adjustments on a given satellite.

FIG. 1 also shows some optional configurations of the preferred embodiment. An E-plane rectangular waveguide bend 18 may be incorporated so as to permit the LNA to extend along the axis of the feed. Also, a coaxial connector 119 may be placed on the broad wall of rectangular waveguide 13 and a shorting plate 110 fastened to the rectangular waveguide flange. With the connector situated one quarter wavelength from the shorting plate and with a probe 111 extending into the rectangular waveguide from the coaxial connector inner conductor, an efficient coupling is afforded to rectangular waveguide 13. This latter feature is useful when desiring to connect the antenna feed to coaxial-type LNA's.

Figure 7B:
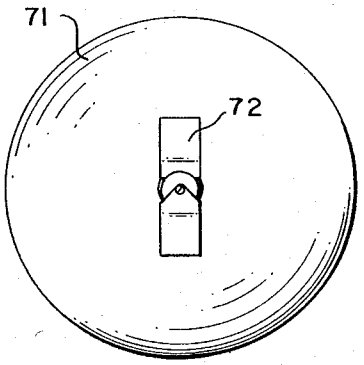
FIG. 7B is an end view of the dipole of FIG. 7A.
Figure 7A:
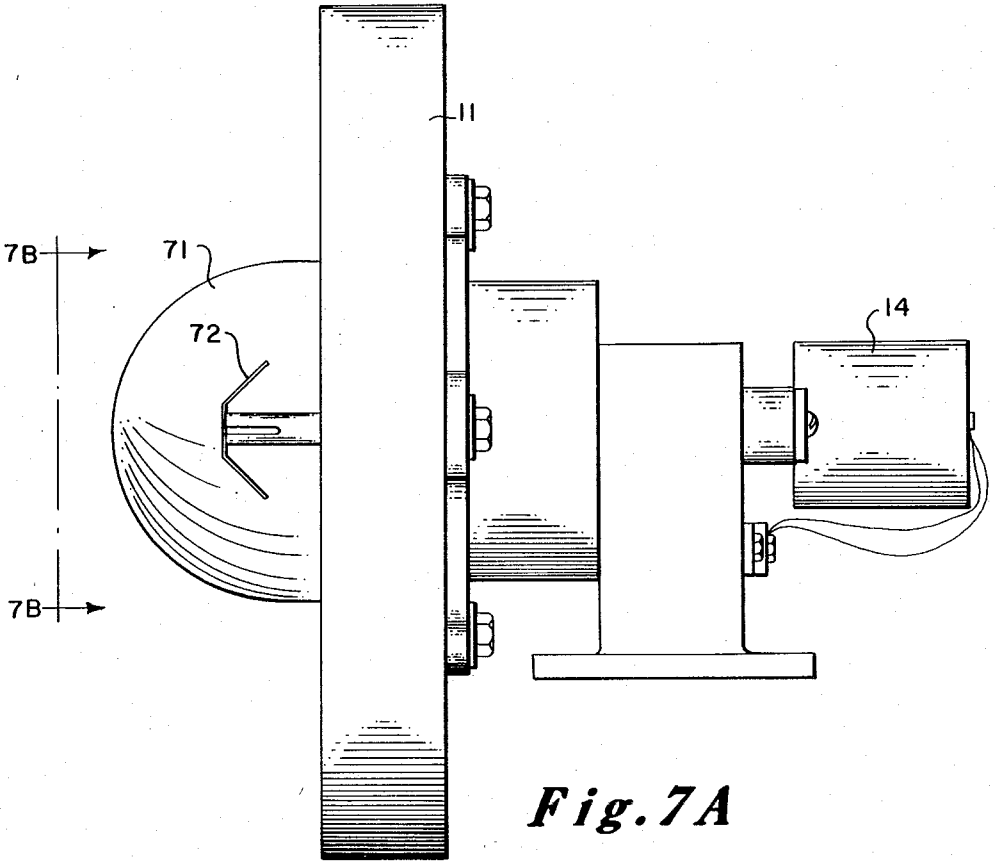
FIG. 7A is a plan view of another embodiment of the invention.

FIGS. 7A and 7B show another embodiment of the invention with the circular waveguide cavity depth reduced and dipole 72 placed outside the face of the corrugations in the corrugated face. A hemispherical dielectric weather cover 71 is placed over the dipole 72 in lieu of the Kapton window 17. Other features remain the same as previously discussed.

This embodiment is useful for illuminating very deep reflectors (those having F/D ratios in the 0.25 to 0.35 range). The dipole arms are bent downward approximately 30°–45°. This bending broadens out the radiation pattern of dipole 72, thus illuminating the reflector more efficiently than the flat dipole 15. The presence of the corrugated face, however, sharply tapers the radiation pattern in a direction along the surface of the corrugations. This tapering leads to a radiation pattern from the feed similar to that shown in FIG. 8.

Figure 8:
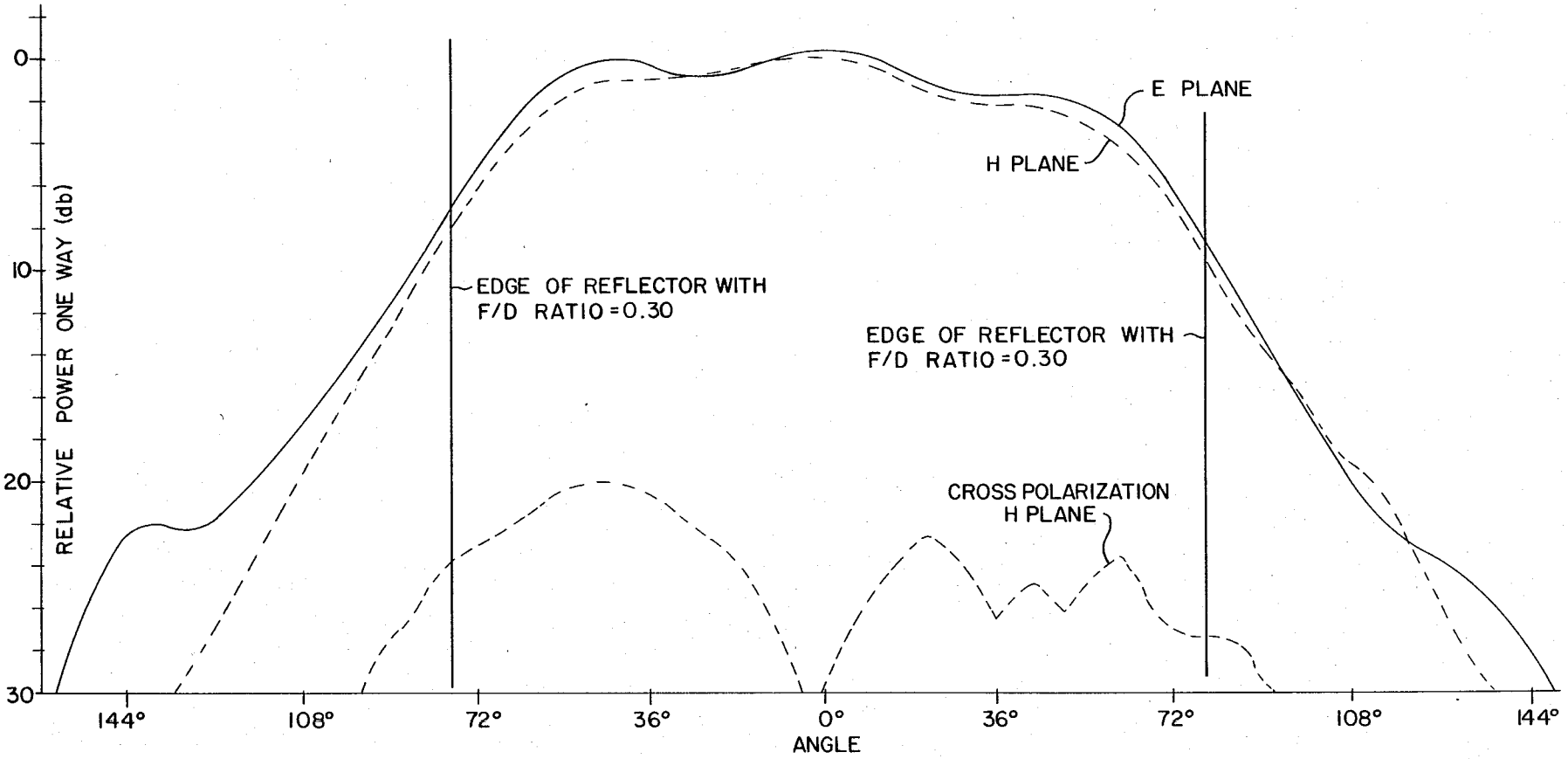
FIG. 8 is a graphical representation illustrating the radiation intensity as a function of angle with the embodiment of FIGS. 7A and 7B.

FIG. 8 shows that the illumination of the angular aperture subtended by a deep reflector is excellent while the sharp amplitude taper for larger angles greatly reduced electrical noise pickup from undesired sources. Such a radiation pattern can improve the gain/-noise temperature ratio of an earth station by as much as one dB.

Figure 9A:
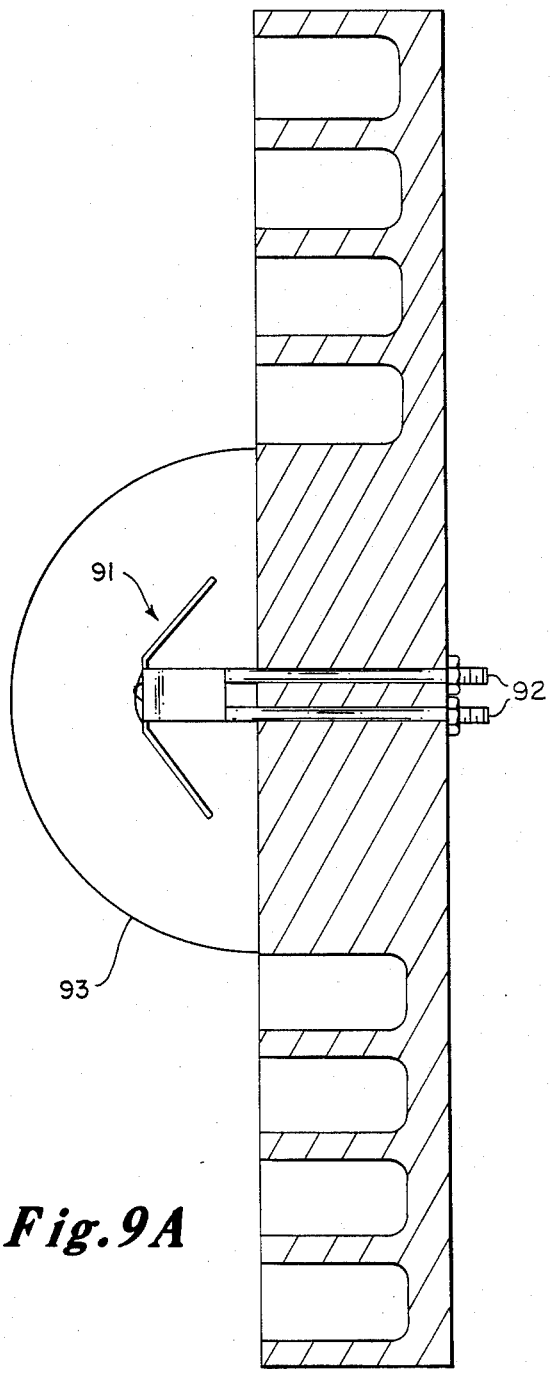
FIG. 9A is a diametrical sectional view of a modification of the embodiment of FIGS. 7A and 7B using a pair of crossed dipoles.
Figure 9B:
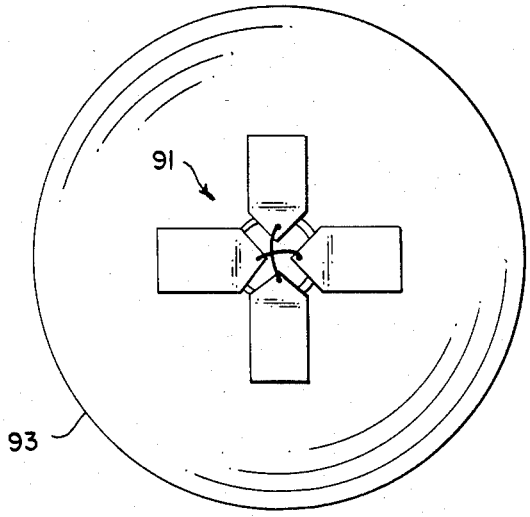
FIG. 9B is an end view of the dipoles of FIG. 9A.

FIGS. 9A and 9B show a modification of the embodiment of FIGS. 7A and 7B. The single dipole is replaced by a pair of dipoles 91 in a standard "turnstile" arrangement. For illuminating deep reflectors, the dipoles are bent downwards as for the single dipole case. Dual LNA's are connected to these dipoles by means of short sections of coaxial line 92. A weather cover 93 is placed over the dipoles for environmental protection. This scheme provides the advantages of superior illumination efficiency with the simplicity of a dual polarized feed and without the high cost of an orthomode transducer.

An example of one construction of the subject invention in a particular frequency band and the electrical performance which has been measured is summarized as follows. The corrugated face is flat and is designed for optimum dimensions for the 3.7–4.2 GHz frequency band. It utilizes four grooves one inch deep and 0.75 inch apart. The circular waveguide 12 is 2.5 inches in diameter and the rectangular waveguide 13 has standard WR229 dimensions (1.145 inches by 2.290 inches internally). The dipole arms are 1.38 inches long, and the dipole is spaced 0.63 inches in from the circular waveguide end. The probe internal to the rectangular waveguide is 0.50 inches long. Electrical characteristics for such a feed with the circular opening flush to the plane of the corrugations are as follows:

| | |
|---|---|
| Frequency Band | 3.7–4.2 GHz |
| Maximum VSWR | 1.3 |
| Polarization purity | 30 dB, minimum |
| Insertion Loss | 0.05 dB maximum |
| Overall Feed Efficiency | 77% for F/D = 0.4 reflector |

With the same dimensions as above, but with the dipole placed a distance of 0.63 inches in front of the corrugations, the same performance obtains except that the overall feed efficiency improves to 80% for reflectors having an F/D ratio of 0.3.

A dual dipole arrangement similar to the above provides identical performance in both ports with an isolation of better than 24 dB between ports.

The invention is embodied in the commercially available Model ESR-40 all-polarization prime focus feed from Seavey Engineering Associates, Inc., 339 Beechwood Street, Cohasset, MA 02025.

There has been described novel apparatus and techniques for constructing a high gain antenna feed offering a simple means for remotely rotating the polarization angle and, for use with deep reflectors, offering improved efficiency through better illumination of the reflector surface. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In an antenna feed having a corrugated surface concentric about the axis of an adjacent circular waveguide having an open end and a closed end formed with a central opening the improvement comprising, polarized dipole antenna means polarized in a predetermined direction rotatably mounted about said axis and coupled to said circular waveguide and spaced from the circular waveguide closed end, means for rotatably supporting said antenna means for rotation about said axis, an output waveguide means for exchanging energy with said dipole antenna means through said central opening, means for coupling said dipole antenna means to said output waveguide means through said central opening comprising an insulating mechanical bearing sleeve seated in said central opening and a coaxial transmission line seated in said sleeve connected to said dipole antenna means and including a coaxial impedance transformer for improving the impedance match between said dipole antenna means and said output waveguide means, and means for rotating the assembly comprising said coaxial transmission line and said dipole antenna means to selectively control the polarization of said antenna feed about said axis, wherein the axial length of said central opening is substantially a quarter wavelength, said dipole antenna means includes at least one pair of arms each substantially a quarter wavelength long extending radially outward from said axis, and the distance between said arms and said closed end is substantially a quarter wavelength.

2. The improvement in accordance with claim 1 wherein, said output waveguide means is a rectangular waveguide adjacent to said circular waveguide closed end, and said coaxial transmission line has an inner conductor extending through said central opening into said rectangular waveguide comprising a probe.

3. The improvement in accordance with claim 2 and further comprising, a dielectric shaft connected to said probe and passing through a wall of said rectangular waveguide opposite said central opening, and motor means connected to said dielectric shaft for selectively rotating said assembly.

4. The improvement in accordance with claim 3 and further comprising control means for establishing fixed stop positions of said said motor means in space quadrature for selectively positioning said dipole antenna means in a selected one of two polarizations in space quadrature.

5. The improvement in accordance with claim 3 and further comprising position transducing means for providing a signal representative of the angular orientation of said dipole antenna means, and closed loop servo circuit means responsive to a command signal and said position signal for energizing said motor means until said command signal and said position signal substantially coincide.

6. The improvement in accordance with claim 5 wherein said source of a position signal comprises a potentiometer mechanically coupled to said dielectric shaft, and further comprising selectively variable-resistance means for providing said command signals.

7. The improvement in accordance with claim 3 wherein said dipole antenna means is outside said circular waveguide.

8. The improvement in accordance with claim 1 wherein said output waveguide means comprises a fixed coaxial connector.

9. The improvement in accordance with claim 3 wherein said dipole antenna means is formed with arms forming an acute angle with said axis to broaden the beam width of said antenna field while establishing a sharp taper to the radiation pattern along the direction of said corrugated surface.

10. The improvement in accordance with claim 3 wherein said dipole antenna means comprises first and second dipoles having first and second pairs of arms respectively in space quadrature about said axis coacting to form a turnstile, a second output waveguide means, and means for coupling said first and second dipoles to said first and second output waveguide means respectively.

11. The improvement in accordance with claim 10 wherein said first and second output waveguide means comprise first and second coaxial connectors respectively.

12. The improvement in accordance with claim 1 wherein said coaxial transmission line includes an inner conductor extending through said central opening into said output waveguide means for a distance corresponding substantially to an eighth wavelength.

* * * * *